US008061987B1

(12) United States Patent
Liang

(10) Patent No.: US 8,061,987 B1
(45) Date of Patent: Nov. 22, 2011

(54) TURBINE BLADE WITH TIP RAIL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 683 days.

(21) Appl. No.: 12/195,461

(22) Filed: Aug. 21, 2008

(51) Int. Cl.
*F01D 5/18* (2006.01)

(52) U.S. Cl. ..... 416/92; 416/97 R

(58) Field of Classification Search ..... 416/97 R, 416/92; 415/115
See application file for complete search history.

(56) References Cited

U.S. PATENT DOCUMENTS 5,192,192 A * 3/1993 Ourhaan ..... 416/97 R
6,224,337 B1 * 5/2001 Lieland et al. ..... 416/97 R
2003/0021684 A1 * 1/2003 Downs et al. ..... 416/92
* cited by examiner

*Primary Examiner* — Matthew W Such
*Assistant Examiner* — Ali Naraghi
(74) *Attorney, Agent, or Firm* — John Ryznic

(57) ABSTRACT

A turbine blade with a squealer pocket formed by a tip rail extending along the pressure side and suction side of the tip. A row of diffusion notches are spaced along the inner sides of the pressure side tip rail and the suction side tip rail, each notch formed by a peak and a valley and opening into the pocket to function as a diffuser. Each notch is supplied with cooling air through a tip convective cooling hole that opens into the bottom of each notch. The pocket floor is without tip cooling holes so that the cooling air discharged into the notches function to push away the vortex flow that would form along the inner side of the tip rails to improve the cooling effectiveness and reduce the tip rail metal temperature.

12 Claims, 4 Drawing Sheets

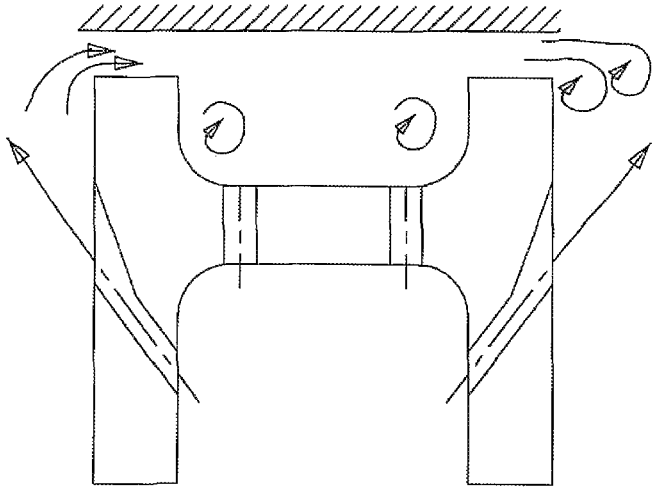
Fig 4
Prior Art
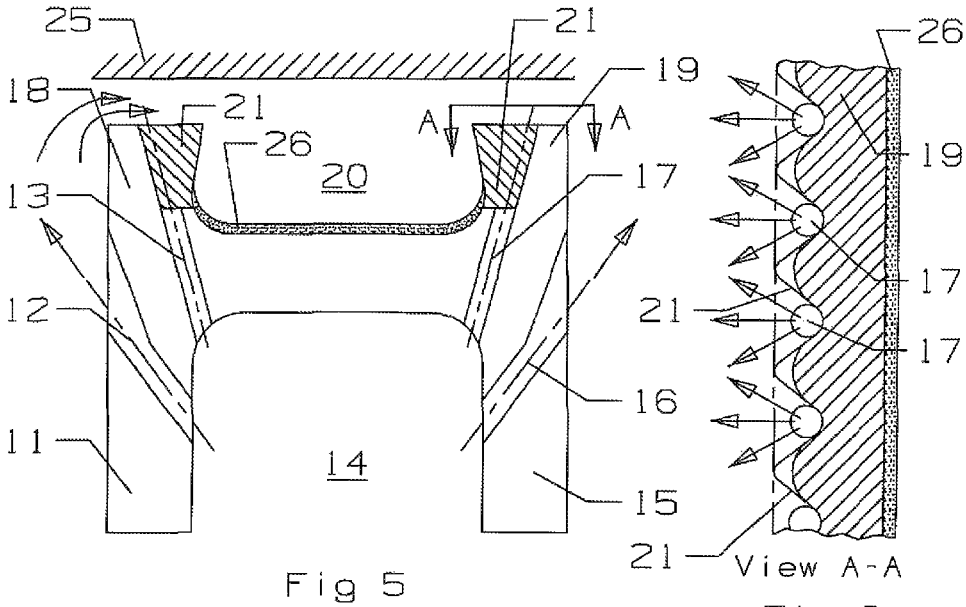
Fig 5
Fig 6

TURBINE BLADE WITH TIP RAIL COOLING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a turbine blade, and more specifically to a turbine blade with tip cooling.

2. Description of the Related Art Including Information Disclosed Under 37 CFR 1.97 and 1.98

In a gas turbine engine, especially an industrial gas turbine engine, the turbine includes stages of turbine blades that rotate within a shroud that forms a gap between the rotating blade tip and the stationary shroud. Engine performance and blade tip life can be increased by minimizing the gap so that less hot gas flow leakage occurs.

High temperature turbine blade tip section heat load is a function of the blade tip leakage flow. A high leakage flow will induce a high heat load onto the blade tip section. Thus, blade tip section sealing and cooling have to be addressed as a single problem. A prior art turbine blade tip design is shown in FIGS. 1-3 and includes a squealer tip rail that extends around the perimeter of the airfoil flush with the airfoil wall to form an inner squealer pocket. The main purpose of incorporating the squealer tip in a blade design is to reduce the blade tip leakage and also to provide for improved rubbing capability for the blade. The narrow tip rail provides for a small surface area to rub up against the inner surface of the shroud that forms the tip gap. Thus, less friction and less heat are developed when the tip rubs.

Traditionally, blade tip cooling is accomplished by drilling holes into the upper extremes of the serpentine coolant passages formed within the body of the blade from both the pressure and suction surfaces near the blade tip edge and the top surface of the squealer cavity. In general, film cooling holes are built in along the airfoil pressure side and suction side tip sections and extend from the leading edge to the trailing edge to provide edge cooling for the blade squealer tip. Also convective cooling holes also built in along the tip rail at the inner portion of the squealer pocket provide additional cooling for the squealer tip rail. Since the blade tip region is subject to severe secondary flow field, this requires a large number of film cooling holes that requires more cooling flow for cooling the blade tip periphery. FIG. 1 shows the prior art squealer tip cooling arrangement and the secondary hot gas flow migration around the blade tip section, FIG. 2 shows a profile view of the pressure side and FIG. 3 shows the suction side each with tip peripheral cooling holes for the prior art turbine blade of FIG. 1.

The blade squealer tip rail is subject to heating from three exposed side; 1) heat load from the airfoil hot gas side surface of the tip rail, 2) heat load from the top portion of the tip rail, and 3) heat load from the back side of the tip rail. Cooling of the squealer tip rail by means of discharge row of film cooling holes along the blade pressure side and suction peripheral and conduction through the base region of the squealer pocket becomes insufficient. This is primarily due to the combination of squealer pocket geometry and the interaction of hot gas secondary flow mixing. The effectiveness induced by the pressure film cooling and tip section convective cooling holes become very limited.

FIG. 4 shows a prior art turbine blade with a tip rail cooling design. A pressure side film cooling hole located on the pressure side wall of the blade and below the pressure side tip rail discharges a film layer of cooling air slightly upward and out onto the surface of the pressure side wall to flow over the pressure side tip rail. A similar suction side film cooling hole is located on the suction side wall. Two tip convective cooling holes discharge cooling air into the squealer pocket and produce a vortex flow of the cooling air as represented by the swirling arrows. These two holes are located adjacent to the inner sides of the tip rails. In the FIG. 4 tip rail design of the prior art, the vortex flow develops on the inner sides of both tip rails and travels along the inner side from the leading edge to the trailing edge of the tip pocket.

This problem associated with turbine airfoil tip edge cooling can be minimized by incorporation of a new and effective blade tip cooling geometry design of the present invention into the prior art airfoil tip section cooling design.

BRIEF SUMMARY OF THE INVENTION

It is an object of the present invention to provide for a turbine blade with an improved tip cooling than the prior art blade tips.

It is another object of the present invention to provide for a turbine blade with less leakage across the tip gap than in the prior art blade tips.

It is another object of the present invention to provide for a turbine blade with improved film cooling effectiveness for the blade tip than the prior art blade tips.

It is another object of the present invention to provide for a turbine blade with improved life.

It is another object of the present invention to provide for an industrial gas turbine engine with improved performance and increased life over the prior art engines.

The turbine blade includes a tip region that forms a squealer pocket with tip rails on both the pressure side and suction side of the blade and a tip floor between the two tip rails. The inner sides of the tip rails include a row of notches opening into the pocket and extending along the tip rails. Each notch has a tip cooling hole opening into the notch to discharge cooling air into the pocket through the notch. Each notch increases in depth in an outward radial direction. The notches retain the cooling air to improve the cooling effectiveness of the tip rail and therefore reduce the blade tip rail metal temperature.

BRIEF DESCRIPTION OF THE SEVERAL VIEWS OF THE DRAWINGS

FIG. 4 shows a cross section view of the blade tip cooling design of the prior art.

FIG. 5 shows a cross section view of the blade tip cooling design of the present invention.

FIG. 6 shows a cross section top view of one of the tip rails with the notches extending along the inner side of the rail used in the present invention.

DETAILED DESCRIPTION OF THE INVENTION

Figure 1:
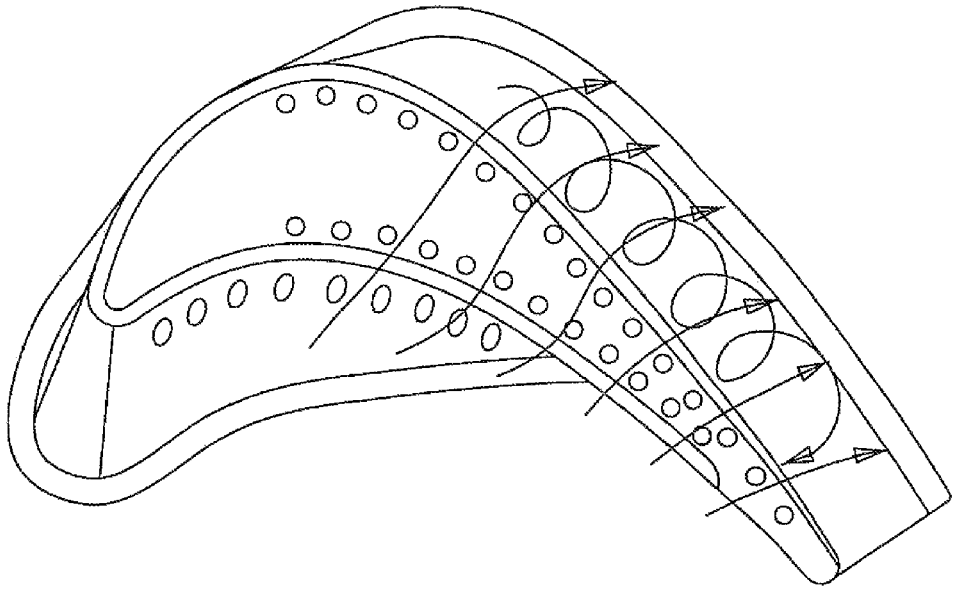
Fig 1 Prior Art
FIG. 1 shows the prior art squealer tip cooling arrangement and the secondary hot gas flow migration around the blade tip section.
Figure 2:
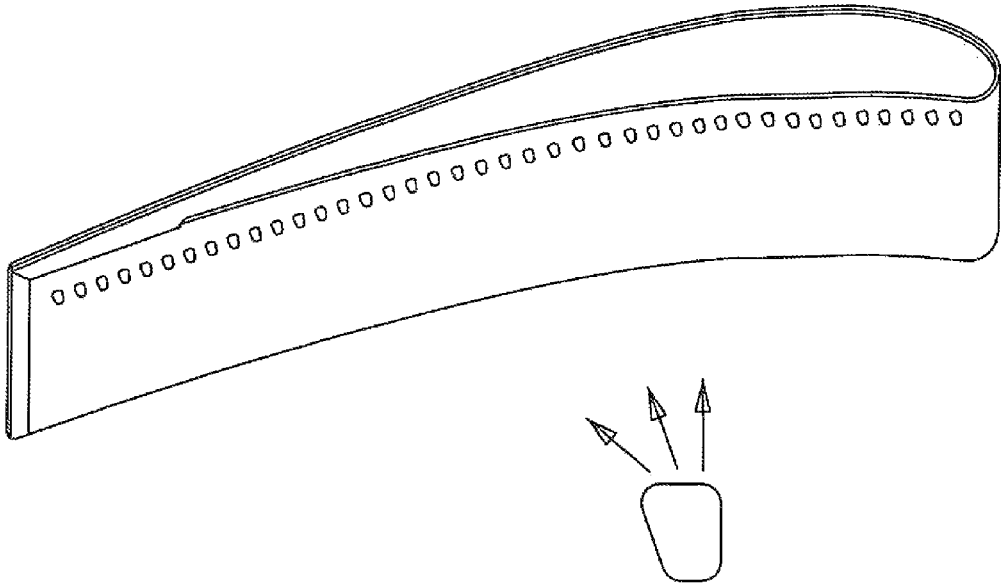
Fig 2 Prior art
FIG. 2 shows a profile view of the pressure side of the prior art blade tip of FIG. 1.
Figure 3:
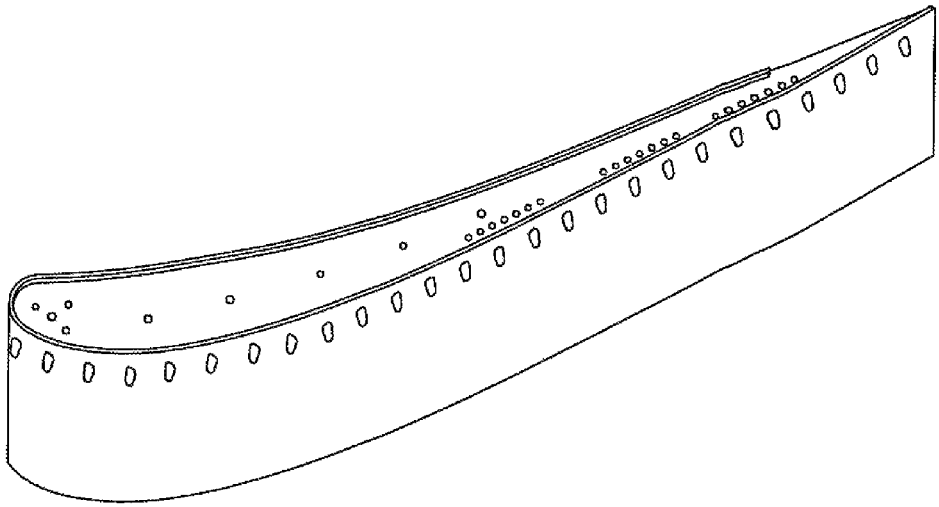
Fig 3 Prior Art
FIG. 3 shows a profile view of the suction side of the prior art blade tip of FIG. 1.

The turbine blade with the tip cooling arrangement of the present invention is shown in FIGS. 5 and 6 the turbine blade includes a pressure side wall 11 with a row of pressure side film cooling holes 12 extending in the chordwise direction of the blade just beneath the tip rail, and a row of tip convective cooling holes 13 extending from the cooling air supply cavity 14 of the blade and into the tip rail 18 on the pressure side. The tip rail includes a tip crown that forms a gap with the BOAS 25. The blade also includes a suction side wall 15 with a row of suction side film cooling holes 16 also extending along the suction side wall just beneath the tip rail. A row of tip convective cooling holes 17 extend from the cooling supply cavity 14 and into the suction side tip rail 19. The squealer pocket 20 is formed between the two tip rails. A TBC is applied along the pocket floor and a portion of the bottoms of the tip rails.

FIG. 6 shows a detailed view of the notches 21 on the suction side tip rail from a top perspective. The tip rail includes a TBC (thermal barrier coating) 26 on the outer surface. On the inner side that faces and forms the pocket 20 is a row of notches 21 having a sinusoidal shape with peaks and valleys. The peaks extend higher (further toward the pocket) at the top end of the tip rail than does the bottom peak in each notch. Thus, the inner side of the tip rails slants inward as seen in FIG. 5. The tip convective cooling holes open into the bottom of the notch and slant outward as seen in FIG. 5. The outer surface of the tip convective cooling holes is generally aligned with the inner surface of the notch to provide for a smooth flow of the cooling air. The tip convective cooling hole has about the same diameter as the notch does on the bottom as seen in FIG. 6. The backside surface of the notches 21 is aligned with the backside surface of the tip convective cooling hole 13 or 17.

The inner sides of the tip rails 18 and 19 each include multiple diffusion shaped notches 21 built into and along the inner tip rail 18 and 19 peripheral opposite to where the pressure and suction side film cooling holes (12,16) are located. Since the pressure side and suction side film cooling holes (12,16) are positioned on the airfoil peripheral tip portion, below the tip peripheral diffusion shaped notches 21, such that cooling flow exiting the film hole is in the same direction of the vortex flow over the blade tip, from the pressure side wall 11 to the suction side wall 15. The cooling air discharges from the backside convective cooling holes (13, 17) relative to the vortex flow and remains within the tip peripheral diffusion shaped notches 21. In addition, the newly created vortex flow within the tip peripheral notches 21 will function as a heat sink to transfer the tip section heat loads from the tip crown and the airfoil external peripheral of the tip rail. The tip peripheral notches 21 also increase the tip section cooling side wetted surface and reduce the hot gas convective surface area from the top portion of the tip rail as well as the backside of the tip rail. This results in a reduction of heat load from the tip crown and backside of the blade tip rail. The notches 21 also reduce the effectiveness conduction thickness of the blade tip rail (18,19) and bring cooling air closer to the backside of the tip rail to increase the effectiveness of backside convection cooling as well as the effectiveness of the TBC 26 on the blade external peripheral. The notches 21 also reduce the blade leakage flow by means of discharging the cooling air perpendicular and against to the leakage flow and thus reduce the effective leakage flow area between the blade tip crown and the blade outer air seal 25 (BOAS).

Because of the presence of the notches on the inner sides of the tip rails and because of the cooling air discharging into the notches, the cooling air pushes away any formation of the vortex flows found in the prior art FIG. 4 design. Also, the cooling air discharge from the tip convective cooling holes flows out the top of each notch to partially block the leakage flow passing through the gap formed between the tip crown and the BOAS.

I claim the following:

1. A turbine blade for use in a gas turbine engine, the blade comprising:

a tip region with a squealer pocket formed by pressure side and suction side tip rails; a squealer pocket floor; a pressure side film cooling hole arranged to discharge a film of cooling air toward the pressure side tip rail; a suction side film cooling hole arranged to discharge a film of cooling air toward the suction side tip rail; a first row of notches extending along an inner side of the pressure side tip rail; a second row of notches extending along an inner side of the suction side tip rail; the notches being formed by peaks and valleys extending toward the squealer pocket and form diffusion shaped notches; and, wherein the diffusion shaped notches are curved inward; and, a tip convective cooling hole opening into each of the notches to discharge cooling air into each notch.

2. The turbine blade of claim 1, and further comprising:

the peaks on the top of each notch is taller than the peaks on the bottom of the notch.

3. The turbine blade of claim 1, and further comprising:

the tip convective cooling holes slant outward toward the tip rails in a cross section view of the blade; and, the inner side of the notches are aligned with the outer side of the tip convective cooling holes.

4. The turbine blade of claim 1, and further comprising:

the diameter of the tip convective cooling holes at the opening into the notch is about the same diameter as the inner side of the notch.

5. The turbine blade of claim 1, and further comprising:

a TBC applied onto the outer surface of the tip rails.

6. The turbine blade of claim 1, and further comprising:

the squealer pocket floor does not have any tip cooling holes to discharge cooling air into the squealer pocket.

7. The turbine blade of claim 1, and further comprising:

the notches function as diffusers for the tip convective cooling holes discharging into the squealer pocket.

8. The turbine blade of claim 1, and further comprising:

the tip rail and the notches form a flat tip crown with the blade outer air seal.

9. A turbine blade for use in a gas turbine engine, the blade comprising:

a tip region with a squealer pocket formed by a tip rail; a squealer pocket floor;

a row of cooling air holes aligned to discharge cooling an inside surface of the tip rail;

and, a row of diffusion shaped surfaces on the inside surface of the tip rail and connected to the row of cooling air holes; and wherein the diffusion shaped surfaces are formed by peaks and valleys; and wherein the diffusion shaped surfaces are curved inward; the cooling air discharged from the row of cooling air holes flows into the notches and is diffused.

10. The turbine blade of claim 9, the diffusion shaped surfaces are formed by peaks and valleys.

11. The turbine blade of claim 9, and further comprising:

a diameter of an outlet of the cooling air holes is equal to a diameter of an inlet to the diffusion shaped surfaces.

12. The turbine blade of claim 9, and further comprising:

a TBC applied onto an outer surface of the tip rail.

* * * * *